US009573733B2

(12) United States Patent
Drewery et al.

(10) Patent No.: US 9,573,733 B2
(45) Date of Patent: Feb. 21, 2017

(54) PACKAGING PRODUCT AND METHOD OF CLOSING A PACKAGING PRODUCT

(71) Applicant: International Business Machines Corporation, Armonk, NY (US)

(72) Inventors: Sarah M. Drewery, Hursley (GB); Michael J. Fish, Hursley (GB); Colin I. Holyoake, Hursley (GB); Keira L. Hopkins, Hampshire (GB)

(73) Assignee: International Business Machines Corporation, Armonk, NY (US)

( * ) Notice: Subject to any disclaimer, the term of this patent is extended or adjusted under 35 U.S.C. 154(b) by 78 days.

(21) Appl. No.: 14/477,304

(22) Filed: Sep. 4, 2014

(65) Prior Publication Data

US 2015/0113922 A1 Apr. 30, 2015

(30) Foreign Application Priority Data

Oct. 28, 2013 (GB) ..... 1318986.5

(51) Int. Cl.

| | |
|---|---|
| ***B65D 17/50*** | (2006.01) |
| ***B65D 39/14*** | (2006.01) |
| ***B65D 39/12*** | (2006.01) |
| ***B65D 75/28*** | (2006.01) |
| ***B65D 77/20*** | (2006.01) |
| *B65B 11/50* | (2006.01) |

(52) U.S. Cl.

CPC ..... *B65D 39/14* (2013.01); *B65D 39/12* (2013.01); *B65D 75/28* (2013.01); *B65D 77/2004* (2013.01); *B65B 11/50* (2013.01); *B65D 17/50* (2013.01); *B65D 17/502* (2013.01)

(58) Field of Classification Search

CPC ... B65D 39/14; B65D 39/12; B65D 2101/003; B65D 2101/00; B65D 2101/0023; B65D 75/28; B65D 17/50; B65D 17/506; B65D 17/501; B65D 17/502

See application file for complete search history.

(56) References Cited

U.S. PATENT DOCUMENTS 595,286 A * 12/1897 Candel ..... A44B 1/34 24/108
662,844 A * 11/1900 Weidmuller ..... A44B 17/0088 24/622

(Continued)

OTHER PUBLICATIONS

Search Report under Section 17 (5) dated Apr. 10, 2014, International Application No. GB1318986.5, 3 pages.

(Continued)

*Primary Examiner* — Anthony Stashick
*Assistant Examiner* — James Way
(74) *Attorney, Agent, or Firm* — Stephen R. Tkacs; Stephen J. Walder, Jr.; Scott S. Dobson

(57) ABSTRACT

A packaging product and a method of closing a packaging product are provided. Closing a packaging product may include providing a first member of the packaging product having an aperture therein and providing a bubble rivet extending through the aperture and having an expanded hollow head portion on one side of the aperture with a neck portion of the bubble rivet being provided in the aperture. The hollow head portion of the bubble rivet is breakable to enable withdrawal of the head portion through the aperture thereby non-reversibly opening the packaging product.

20 Claims, 8 Drawing Sheets

(56) References Cited

U.S. PATENT DOCUMENTS

| | | | | |
|---|---|---|---|---|
| 2,321,755 | A * | 6/1943 | Kost | F16B 5/045 29/512 |
| 2,562,721 | A * | 7/1951 | Jakosky | F16B 19/12 29/421.1 |
| 2,933,793 | A * | 4/1960 | Steinberg | A44B 17/007 24/622 |
| 3,076,542 | A * | 2/1963 | Lowry | B65D 73/005 206/471 |
| 3,094,757 | A * | 6/1963 | Blake | A44B 17/00 24/265 R |
| 3,156,962 | A * | 11/1964 | Henson | A44B 17/0052 24/113 R |
| 5,520,301 | A | 5/1996 | Sohn | |
| 5,733,086 | A * | 3/1998 | Jakob | F16B 19/1027 411/34 |
| 6,726,364 | B2 | 4/2004 | Perell et al. | |
| 2009/0107866 | A1 | 4/2009 | Dunn-Rankin | |
| 2010/0150481 | A1 | 6/2010 | Perell et al. | |

OTHER PUBLICATIONS

"Tri-Fold Clam Shells", http://www.clamshell-packaging.com/clam-shells.html, retrieved from the internet on Jun. 12, 2014, 1 page.

Gray, B.L et al., "Novel Interconnection Technologies for Integrated Microfluidic Systems", http://www.sciencedirect.com/science/article/pii/S0924424799001855, Abstract only, retrieved from the internet on Jun. 12, 2014, 4 pages.

* cited by examiner

PACKAGING PRODUCT AND METHOD OF CLOSING A PACKAGING PRODUCT

BACKGROUND

This invention relates to the field of packaging. In particular, the invention relates to a packaging product and method of closing a packaging product.

Many forms of plastic packaging, especially vacuum packaging, is very hard to open. If the packaging has been moulded around the contents, the packaging is even harder to open.

Plastic packaging often has sealed edges which may be pressed closed during manufacture. Opening such packaging can be extremely frustrating and risks the contents and the safety of the user as knives or scissors must be used on very tough plastic.

Other forms of plastic packaging use moulded poppers at the edge of the packaging with a top layer of plastic having protruding poppers and a bottom layer of plastic having corresponding holes into which the protruding poppers fit sufficiently tightly so as to hold the top and bottom layers together. Such moulded poppers are easier to open than a sealed edge and can be re-closed after opening. This risks the packaging being opened in a retail environment and the contents stolen or tampered with.

Yet further known forms of packaging use separate fasteners to hold two members of the packaging together. However, the use of additional items in the packaging increases the cost and complexity of manufacture.

Therefore, there is a need in the art to address the aforementioned problems.

SUMMARY

According to a first illustrative embodiment, there is provided a method for closing a packaging product, comprising: providing a first member of the packaging product having an aperture therein; providing a bubble rivet extending through the aperture having an expanded hollow head portion on one side of the aperture with a neck portion of the bubble rivet being provided in the aperture, wherein the hollow head portion of the bubble rivet is breakable to enable withdrawal of the head portion through the aperture thereby non-reversibly opening the packaging product.

In one embodiment, the method may include: providing a second member of the packaging product and extruding a portion of the second member through the aperture in the first member to form the bubble rivet; and providing a third member applied to the second member to seal the extruded bubble rivet.

In another embodiment, the method may include: providing a second member of the packaging product having an aperture corresponding to the aperture in the first member; wherein the bubble rivet is formed of the hollow head portion, the neck portion, and a backing plate, and the hollow head portion or the backing plate of the bubble rivet is pushed through the apertures in both the first member and the second member; expanding the hollow head portion on an outside of the first member with the backing plate adjacent the outside of the second member.

In a further embodiment, the method may include: providing a second member of the packaging product having an aperture corresponding to the aperture in the first member; wherein the bubble rivet is formed of the hollow head portion, the neck portion, and a second hollow head portion, and one hollow head portion of the bubble rivet is pushed through the apertures in both the first member and the second member; expanding one or more of the hollow head portions on one or more of the outside of the first member and the outside of the second member.

A first hollow head portion may be provided in an inflated state, and the method may include: inserting an uninflated second head portion through the apertures; and inflating the second hollow head portion via a one-way valve by squeezing the first hollow head portion.

In some embodiments, the neck portion may be a hollow tube.

The method may include providing multiple bubble rivets around the edge of a packaging product.

In one embodiment, the bubble rivet may have a generally circular cross section. In another embodiment, the bubble rivet may have an elongate cross section to provide an extended elongate area of closure.

The bubble rivet may have graphics applied to it.

According to a second illustrative embodiment, there is provided a packaging product comprising: a first member of the packaging product having an aperture therein; a bubble rivet provided through the aperture, the bubble rivet having an expandable hollow head portion which in use is provided on one side of the aperture and a neck portion which in use is provided in the aperture, wherein the hollow head portion of the bubble rivet is breakable to enable withdrawal of the head portion through the aperture thereby non-reversibly opening the packaging product.

In one embodiment, the product may include: a second member of the packaging product, and wherein a portion of the second member is extruded through the aperture in the first member to form the bubble rivet; and a third member applicable to the second member to seal the extruded bubble rivets.

In another embodiment, the product may include: a second member of the packaging product having an aperture corresponding to the aperture in the first member; wherein the bubble rivet is formed of the hollow head portion, the neck portion, and a backing plate, and the hollow head portion or the backing plate of the bubble rivet is pushable through the apertures in both the first member and the second member; the hollow head portion being expandable on an outside of the first member with the backing plate adjacent the outside of the second member.

In a further embodiment, the product may include: a second member of the packaging product having an aperture corresponding to the aperture in the first member; wherein the bubble rivet is formed of the hollow head portion, the neck portion, and a second hollow head portion, and one hollow head portion of the bubble rivet is pushed through the apertures in both the first member and the second member; at least one of the hollow head portions being expandable on one or more of the outside of the first member and the outside of the second member.

The described aspects of the invention provide the advantage of allowing a packaging to be tightly-sealed and yet easily opened. A further advantage is that the described method of closing the packaging is non-reversible and shows if the closure has been opened which has benefits for providing a tamper-free indication for the product.

BRIEF DESCRIPTION OF THE DRAWINGS

The subject matter regarded as the invention is particularly pointed out and distinctly claimed, in the concluding portion of the specification. The invention, both as to organization and method of operation, together with objects, features, and advantages thereof, may best be understood by reference to the following detailed description when read, with the accompanying drawings.

Preferred embodiments of the present invention will now be described, by way of example only, with reference to the following drawings in which.

DETAILED DESCRIPTION

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numbers may be repeated among the figures to indicate corresponding or analogous features.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

A packaging product is provided with tamper-evident bubble rivets for releasable fastening of two an opening in the packaging product. In one embodiment, the opening in the plastic product is formed by two planar surfaces which may be pulled apart. The bubble rivet may comprise a flexible plastics material enclosing, in use, a volume of gas or liquid. The bubble rivet may have a neck portion and an expanded, head region, wherein the bubble rivet is released by bursting the plastics materials to reduce the volume of the head portion by releasing the gas or liquid contained therein.

Figure 1A:
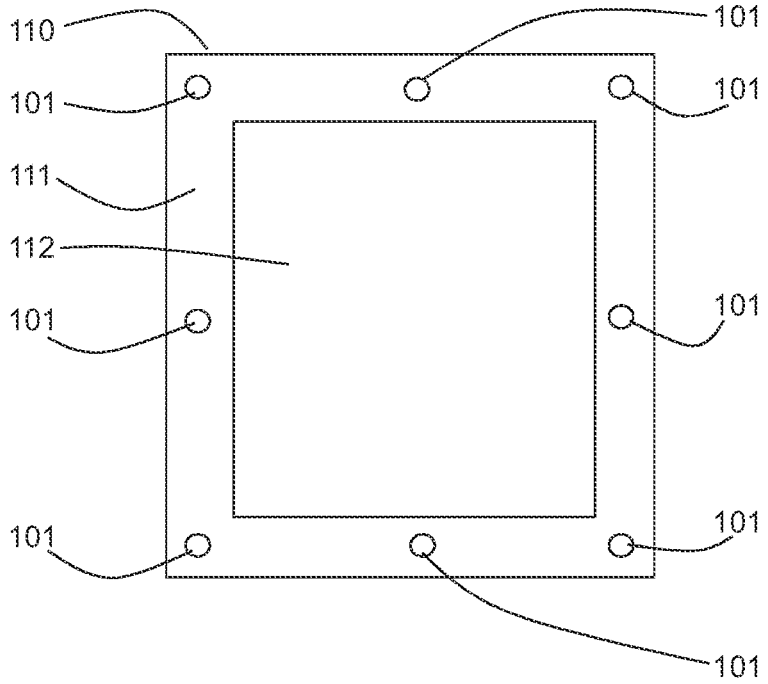
FIGS. 1A and 1B are plan views of two example embodiments of a packaging product with a closure.
Figure 1B:
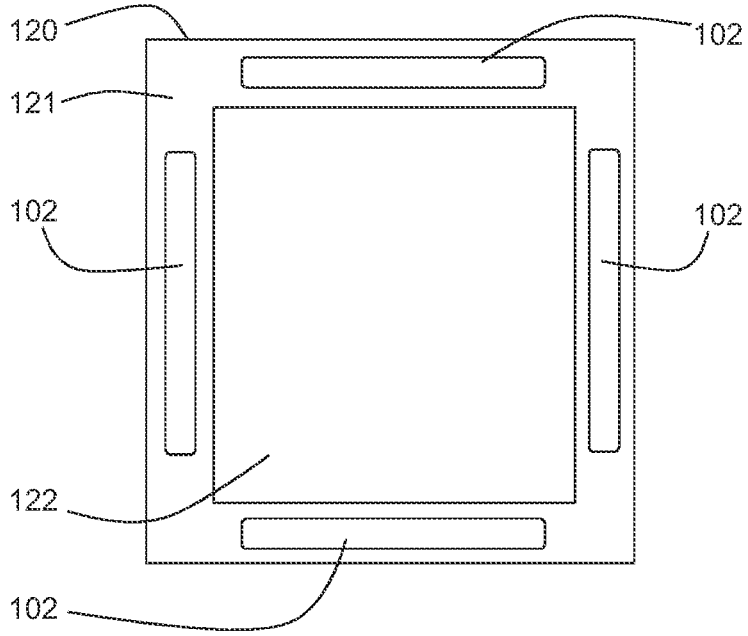

Referring to FIGS. 1A and 1B, two example embodiments are shown of a packaging product 110, 120. The packaging product 110, 120 is generally formed of two planar members (shown one on top of the other in the figures), which are sealed together around the periphery 111, 121 of the packaging product 110, 120 enclosing a volume 112, 122 in which an item may be enclosed.

The described closure in the form of a bubble rivet 101, 102 is provided to close the two planar members together around the periphery 111, 121. Multiple bubble rivets 101, 102 may be provided spaced around the periphery 111, 121.

In the first example embodiment shown in FIG. 1A, multiple bubble rivets 101 are shown which each have a circular shape when viewed from above. These circular bubble rivets 101 secure the two planar members together at discrete points around the periphery 111 of the packaging product 110.

In the second example embodiment shown in FIG. 1B, multiple bubble rivets 102 are shown which each have an elongate shape when viewed from above. These elongate bubble rivets 102 secure the two planar members together along a straight line and may be provided around the periphery 121 of the packaging product 120.

Figure 2A:
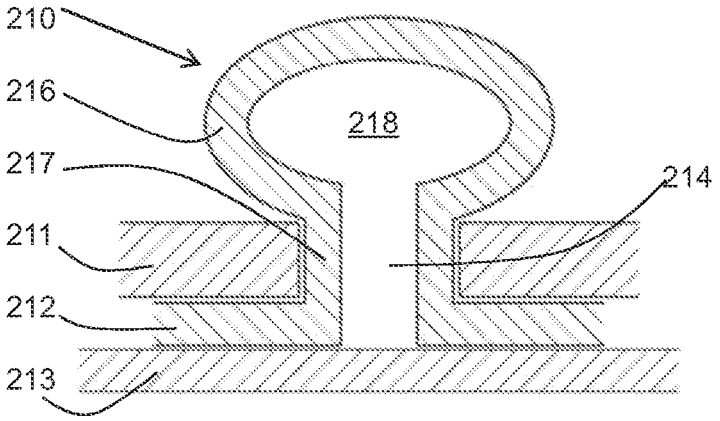
FIGS. 2A to 2C are cross-sections three example embodiments of a closure of a packaging product.
Figure 2B:
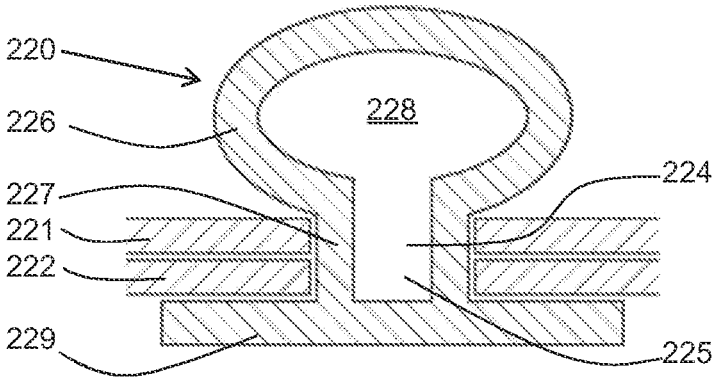
Figure 2C:
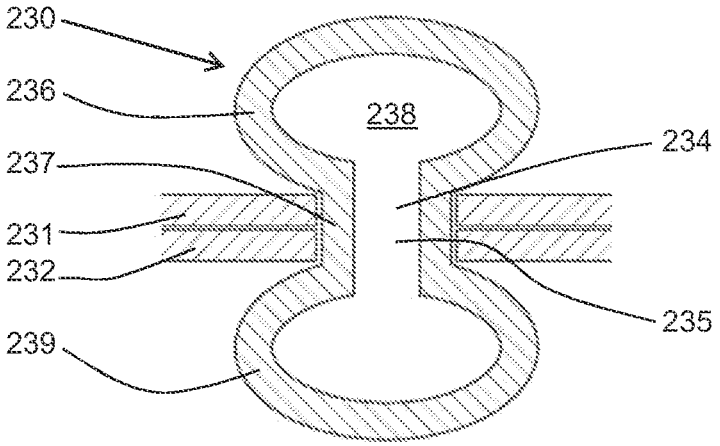

Referring to FIGS. 2A to 2C, cross-sections of three example embodiments are shown of the described closure 210, 220, 230. Each of the example closures 210, 220, 230 may be provided as a point closure as shown in FIG. 1A with a circular form as viewed from above, or as an elongate closure as shown in FIG. 1B with an elongate form as viewed from above.

Each of the example closures 210, 220, 230 is provided for securing two members together. A first member 211, 221, 231 may be provided as a planar member, a curved member, an elongate member or any other form and is provided with an aperture 214, 224, 234 therein through which the closure 210, 220, 230 is secured.

In the first example embodiment shown in FIG. 2A, the first member 211 is to be secured to a second member 212, which together with a third member 213 forms part of the closure 210.

In the second and third embodiments shown in FIGS. 2B and 2C, the first member 221, 231 is to be secured to a second member 222, 232 which has an aperture 225, 235 corresponding in size and location with the aperture 225, 235 in the first member 221, 231 and through which the closure 220, 230 is secured.

The second member 212, 222, 232 in all embodiments may also be a planar member, curved member, elongate member or any other shape which may be closed or sealed against the first member 211, 221, 231.

In all three example embodiments, the closure 210, 220, 230 comprises a head portion 216, 226, 236 and a neck portion 217, 227, 237. The head portion 216, 226, 236 encloses a cavity 218, 228, 238 which may contain gas or liquid. The cavity 218, 228, 238 may extend into the neck portion 217, 227, 237. The neck portion 217, 227, 237 may be located, in use, in the aperture 214, 224, 234 of the first member 211, 221, 231 and, in the second and third embodiments, in the aperture 225, 235 of the second member 222, 232. The head portion 216, 226, 236 may protrude outside the first member 211, 221, 231 and may have a circumference (in the case of the circular embodiment) or width (in the case of the elongate embodiment) greater than the apertures 214, 224, 234, 225, 235.

In use, the head portion 216, 226, 236 of the closure 210, 220, 230 is broken or burst in order to allow the head portion 216, 226, 236 to be retracted through the aperture 214, 221, 234 and unsecure or release the first member 211, 221, 231 from the second member 212, 222, 232.

Referring to FIG. 2A, a first example embodiment of a closure 210 is shown in which a second member 212 is provided adjacent the first member 212 and the second member 212 is extruded through the aperture 214 in the first member 212 to form the closure 210 with a hollow head portion 216 outside the first member 212 and a neck portion 217 (which may also be hollow) in the aperture 214. A third member 213 is provided which seals the extruded second member 212 to enclose the cavity 218 in the head portion 216. Further details of the formation of this closure 210 are provided in relation to FIGS. 3A and 3B.

In order to be extruded through the aperture 214, the second member 212 may be formed of a flexible plastic material.

Referring to FIG. 2B, a second example embodiment of a closure 220 is shown in which first and second members 221, 222 are held together by the closure 220 and the closure 220 is a separate item which may be inserted through the apertures 224, 225 in the first and second members 221, 222. The closure 220 may have a backing plate 229 attached to the neck portion 227 and opposed to the head portion 226. The backing plate 229 may hold the closure 220 in place against the second member 222 and may be greater in size than the aperture 225 in the second member 222. Further details of the use of this closure 220 are provided in relation to FIGS. 4A to 4C.

Referring to FIG. 2C, a third example embodiment of a closure 230 is shown in which first and second members 231, 232 are held together by the closure 230 and the closure 230 is a separate item which may be inserted through the apertures 234, 235 in the first and second members 231, 232. The closure 230 may have a second head portion 239 attached to the neck portion 237 and opposed to the first head portion 236. The second head portion 239 may hold the closure 230 in place against the second member 232 and may be greater in size than the aperture 235 in the second member 232. Further details of the use of this closure 230 are provided in relation to FIGS. 5A to 5C.

The construction of the head portion 216, 226, 236 may be from medium density polythene or polycarbonate, or equivalent material, and its thickness may be varied to ensure strength where needed.

Figure 3A:
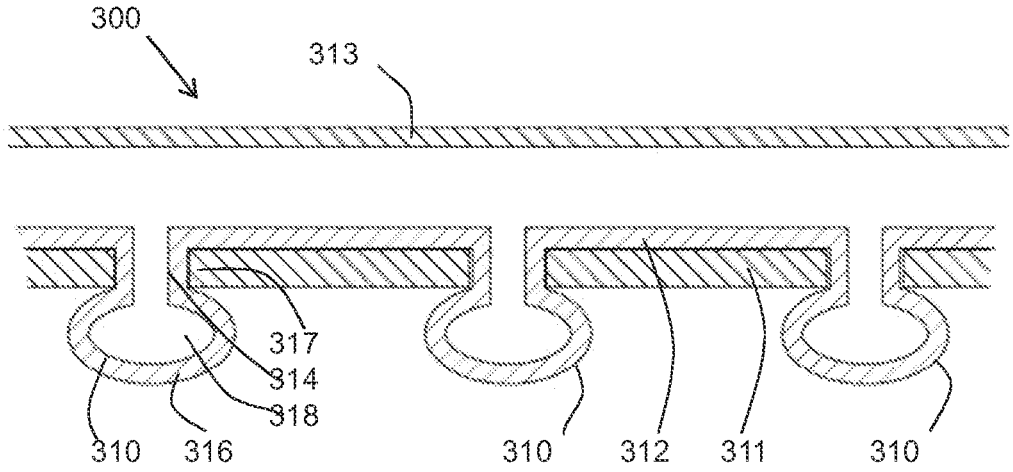
FIGS. 3A and 3B are cross-sections of two stages of a first embodiment of a method of closure of a packaging product.
Figure 3B:
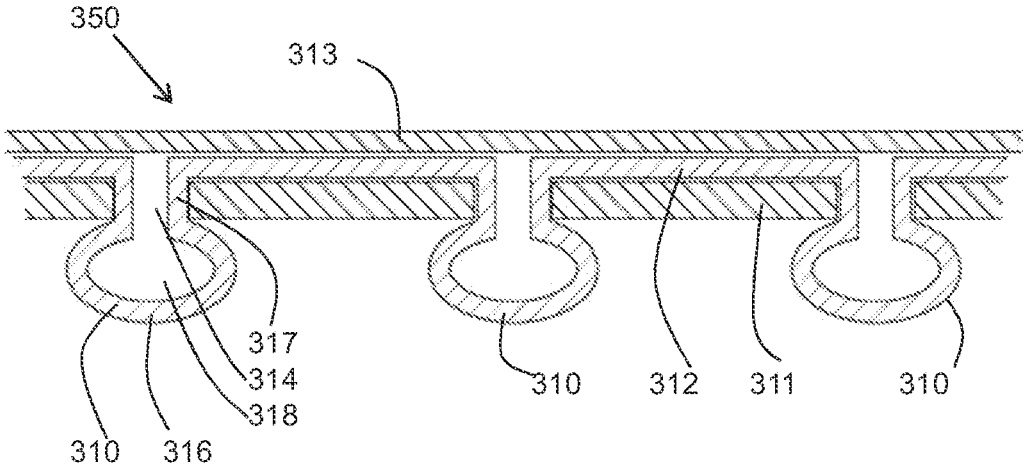

Referring to FIGS. 3A and 3B, cross-sections 300, 350 of two stages of a first embodiment of a method of closure are shown which result in multiple closures of the form shown in FIG. 2A.

A first member 311 may be provided having multiple apertures 314 provided therein and space apart. The apertures 314 may be evenly spaced apart in the first member 311 to provide an even degree of closure along the first member 311, or they may be clustered at an area of the first member 311 requiring strong closure.

A second member 312 may be provided in the form of a thin member which may be, for example, a thin sheet of plastics material, which is provided adjacent the first member 311. The second member 312 may be extruded through the apertures 314 in the first member 311, through use of vacuum forming or application of differential pressure, and then attached to the third member 313 using adhesive or a heated seal.

The extruded portions of the second member 312 which protrude through the apertures 314 form closures 310 each having a hollow head portion 316 on the opposite side of the first member 311 to the second member 312 and a neck portion 317 within the aperture 314.

The hollow head portions 316 may be filled with a gas or liquid or may naturally have air inside the hollow cavity and a third member 313 may be sealed over the second member 312 enclosing the hollow head portions 316 (as shown in FIG. 3B).

Figure 4A:
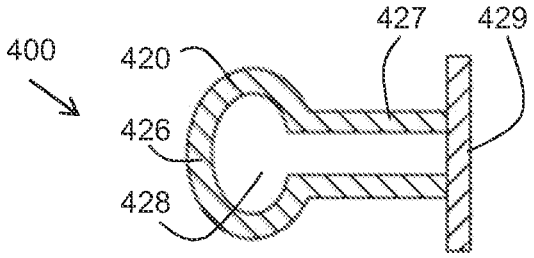
FIGS. 4A to 4C are cross-sections of three stages of a second embodiment of a method of closure of a packaging product.
Figure 4B:
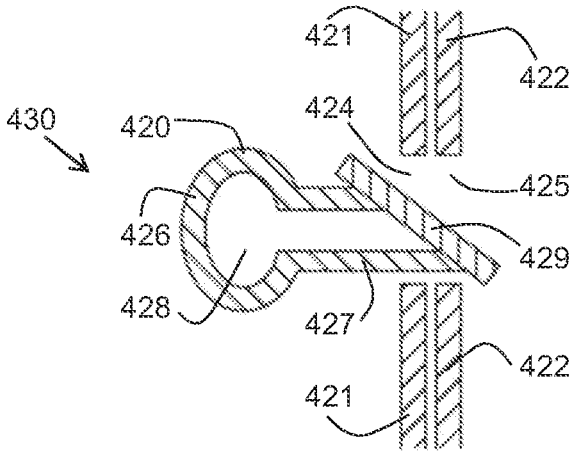
Figure 4C:
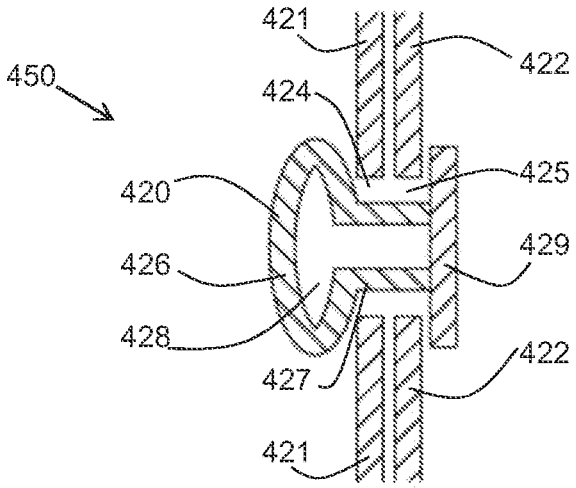

Referring to FIGS. 4A to 4C, cross-sections 400, 430, 450 of three stages of a second embodiment of a method of closure are shown which result in a closure 420 of the form shown in FIG. 2B.

FIG. 4A shows a closure 420 having a hollow head portion 426 and a neck portion 427. A cavity 428 may be provided in the head portion 426 which may extend into the neck portion 427. A backing plate 429 may be provided across the neck portion 427 at the opposite end of the neck portion 427 to the head portion 426. The head and neck portions 426, 427 may be formed of a flexible plastics material and the backing plate 429 may be formed of a more rigid material.

FIG. 4B illustrates a method of inserting the closure 420 through apertures 424 and 425 in first and second members 421, 422 respectively, wherein the first and second members 421, 422 are to be secured adjacent each other. The backing plate 429 may be inserted through the apertures 424, 425 by tilting it to fit through the apertures 424, 425. Alternatively, the head portion 426 may be squeezed through the apertures 424, 425 making use of its flexible material.

FIG. 4C illustrates the closure 420 in position and partially compressed against the first and second members 421, 422 to form a seal. The flattened head portion 426 is wider than the apertures 424, 425.

Figure 5A:
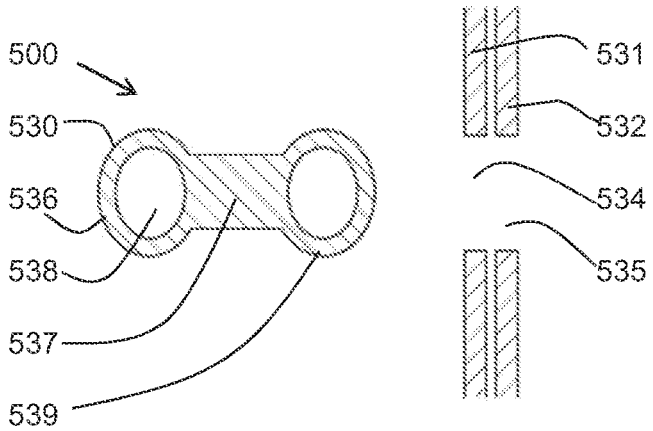
FIGS. 5A to 5C are cross-sections of three stages of a third, embodiment of a method of closure of a packaging product.
Figure 5B:
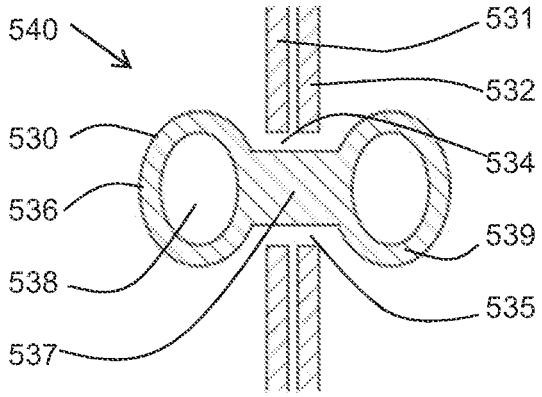
Figure 5C:
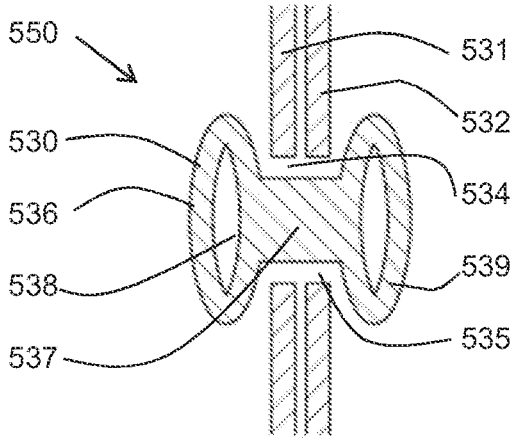

Referring to FIGS. 5A to 5C, cross-sections 500, 540, 550 of three stages of a third embodiment of a method of closure are shown which result in a closure 530 of the form shown in FIG. 2C.

FIG. 5A shows a closure 530 having a hollow head portion 536 and a neck portion 537. A cavity 538 may be provided in the head portion 536 which may extend into the neck portion 537. Alternatively, the neck portion 537 may be of solid material. A second head portion 539 may be provided at the opposite end of the neck portion 537 to the first head portion 536 forming a symmetrical closure.

FIG. 5B illustrates a method of inserting the closure 530 through apertures 534 and 535 in first and second members 531, 532 respectively, wherein the first and second members 531, 532 are to be secured adjacent each other.

The closure 530 may be formed with the first and second head portions 536, 539 uninflated and the head portions 536, 539 may be inflated once the closure 530 is in position through the apertures 534, 535 in the first and second members 531, 532. The inflation may be carried out using a one-way valve and air introduction. Alternatively, the closure 530 may be formed with the first head portion 536 inflated and the second head portion 539 uninflated. The second head portion 539 may be inflated once the closure 530 is in position through the apertures 534, 535 in the first and second members 531, 532. The inflation may be carried out by compressing the first head portion 536 to force air from the neck portion 537 into the second head portion 539 via a one-way valve.

This form of closure 530 may be used in a domestic situation and may be retrofitted to a packaging product by a user. This enables a packaging product to be reused.

FIG. 5C shows the closure 530 having inflated head portions 536, 539 thereby securing the first and second members 531, 532 together.

Figure 6:
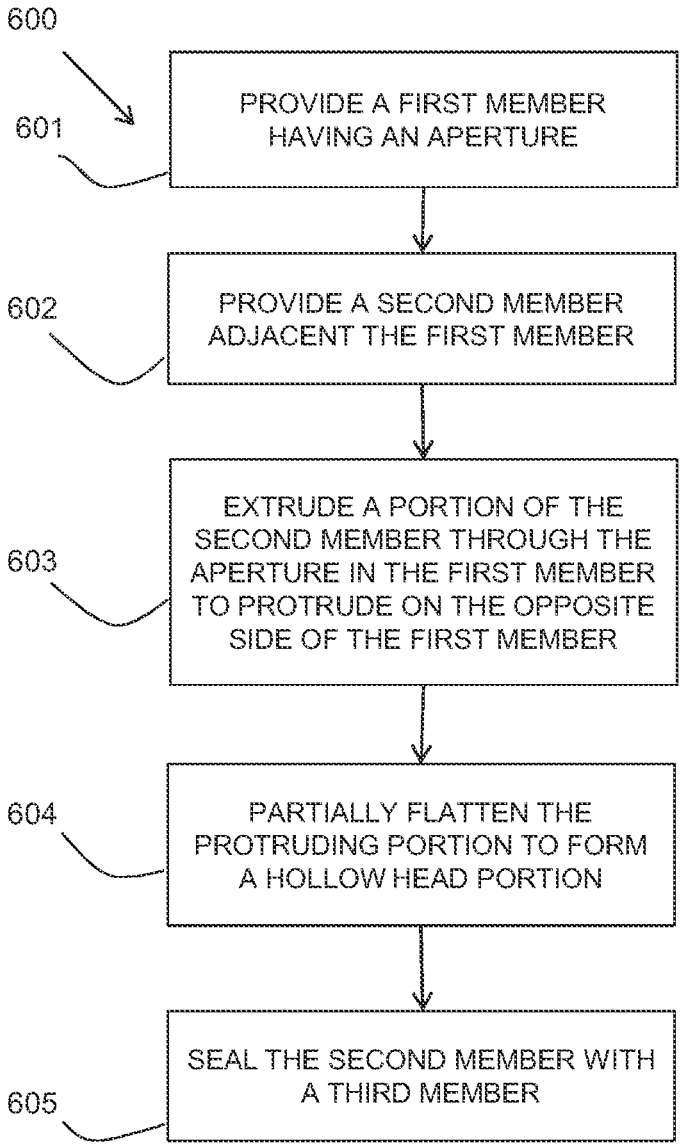
FIG. 6 is a flow diagram of a first embodiment of a method of closing a packaging product.

Referring to FIG. 6, a flow diagram 600 shows a first example embodiment of a method of closing a packaging product.

The method may include providing 601 a first member having at least one aperture in it. The first member may be a planar sheet member or may be another form of member such as a curved sheet member, an elongate member, etc. There may be more than one aperture spaced along the first member. The first member may be formed of a hard plastics material, for example, a clear plastics material suitable for packaging.

A second member may be provided 602 for adjacent the first member. The second member may be formed of a thin plastic material, thinner than the material of the first member.

The second member may be extruded 603 to push or pull a portion of the second member through the aperture in the first member to protrude on the opposite side of the first member. The protruding, extruded portion of the second member may form a hollow bubble or head portion with a neck portion provided in the aperture.

The protruding head portion may be partially flattened 604 to enlarge it and to form a tight seal with the first member. The head portion may be filled with a gas or liquid or may naturally be full of air.

A third member may be sealed 605 over the second member to enclose the openings of the extruded portions of the second member.

Figure 7:
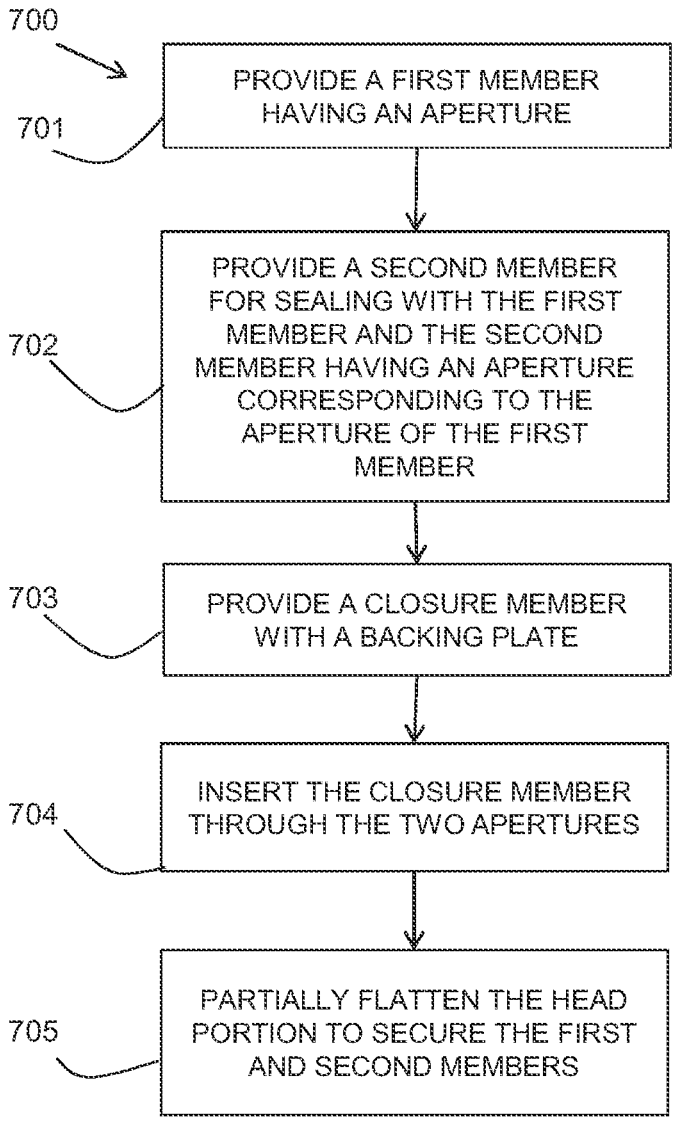
FIG. 7 is a flow diagram of a second embodiment of a method, of closing a packaging product.

Referring to FIG. 7, a flow diagram 700 shows a second example embodiment of a method of closing a packaging product.

A first member may be provided 701 having an aperture. A second member may be provided 702 for sealing against the first member. For example, the first and second members may be two layers of a packaging product which need to be sealed together along an edge. The first and second members, in this embodiment, may be a transparent plastic material suitable for packaging a product.

A separate closure member may be provided 703 in the form of a bubble rivet having a head portion on one end of a neck portion and a backing plate on the other end of the neck portion. The closure may be formed of a more flexible plastic material.

The closure may be inserted 704 through the apertures in the first and second members to secure them together. The closure may be inserted by squashing the head portion through the apertures or by tilting the backing plate through the apertures.

Once inserted, the head portion may be partially flattened 705 to secure the first and second members more tightly together.

Figure 8:
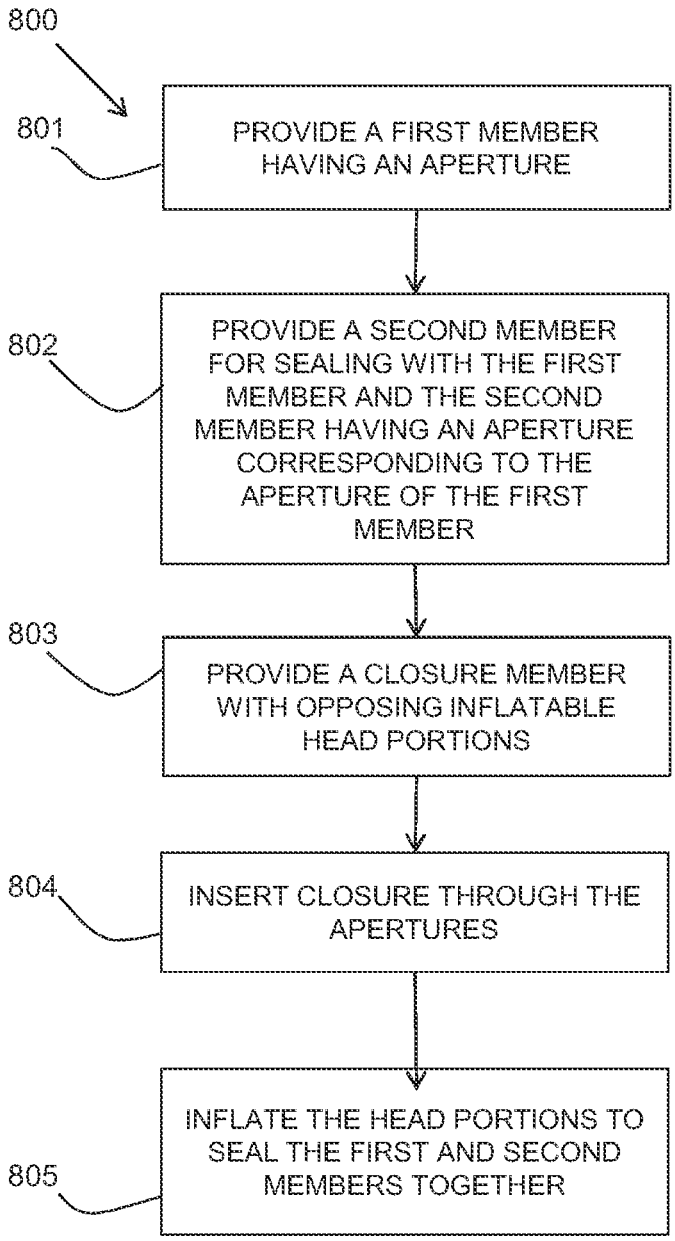
FIG. 8 is a flow diagram of a third embodiment of a method of closing a packaging product.

Referring to FIG. 8, a flow diagram 800 shows a third example embodiment of a method of closing a packaging product. This example method may be used by a consumer in a domestic situation to seal a package.

A first member may be provided 801 having an aperture. A second member may be provided 802 for sealing against the first member. For example, the first and second members may be two layers of a packaging product which need to be sealed together along an edge. The first and second members, in this embodiment, may be a transparent plastic material suitable for packaging a product.

A separate closure member may be provided 803 in the form of a more flexible plastic material. The closure may have a neck portion with head portions at each end, wherein one or both of the head portions are deflated for insertion 804 through the apertures.

Once inserted through the apertures so that the neck portion of the closure is provided in the apertures, the one or more deflated head portions may be inflated 805 using a provided inflation method.

The described methods and closures result in a bubble rivet that allows packaging to be sealed tightly but also easily opened. The breakable bubble rivet is broken to open the packaging product and therefore it is easy to see that the packaging product has been opened.

The packaging product may be applied in many different packaging areas including but not limited to: electronic and computer parts, airplane food, takeaway food, food shopping packaging, etc.

The bubble rivets may be thin enough to be broken by hand.

The bubble rivets may be colour coded or personalized (for example, to include a logo or colour scheme). The bubble rivets also allow manufacturers to identify when a seal has broken on their products. This would not only provide marketing for the manufacturer but also security awareness about the opening of the packaging product.

Improvements and modifications can be made to the forego without departing from the scope of the present invention.

The invention claimed is:

1. A method for closing a packaging product, comprising:

providing a first member of the packaging product having an aperture therein;

providing a bubble rivet extending through the aperture having an expanded hollow head portion on one side of the aperture with a neck portion of the bubble rivet being provided in the aperture, wherein the bubble rivet comprises a flexible plastics material enclosing a volume of gas or liquid, wherein the hollow head portion of the bubble rivet is breakable to enable withdrawal of the head portion through the aperture thereby non-reversibly opening the packaging product, and wherein the bubble rivet is released by bursting the flexible plastics material to reduce the volume of the head portion by releasing the gas or liquid contained therein.

2. The method as claimed in claim 1, further comprising:

providing a second member of the packaging product and extruding a portion of the second member through the aperture in the first member to form the bubble rivet; and providing a third member applied to the second member to seal the extruded bubble rivet such that the gas or liquid is sealed within the bubble rivet.

3. The method as claimed in claim 1, further comprising:

providing a second member of the packaging product having an aperture corresponding to the aperture in the first member, wherein the bubble rivet is formed of the hollow head portion, the neck portion, and a backing plate, and the hollow head portion or the backing plate of the bubble rivet is pushed through the apertures in both the first member and the second member; and expanding the hollow head portion on an outside of the first member with backing plate adjacent the outside of the second member.

4. The method as claimed in claim 1, further comprising:

providing a second member of the packaging product having an aperture corresponding to the aperture in the first member, wherein the bubble rivet is formed of the hollow head portion, the neck portion, and a second hollow head portion, and one hollow head portion of the bubble rivet is pushed through the apertures in both the tint member and the second member;

expanding one or more of the hollow head portions one or more of the outside of the first member and the outside of the second member.

5. The method as claimed in claim 4, wherein a first hollow head portion provided in an inflated state, the method further comprising:

inserting an uninflated second head portion through the apertures; and inflating the second hollow head portion via a one-way valve by squeezing the first hollow head portion.

6. The method s claimed in claim 1, wherein the neck portion is a hollow tube.

7. The method as claimed in claim 1, further comprising providing multiple bubble rivets around the edge of a packaging product.

8. The method as claimed in claim 1, wherein the bubble rivet has a generally circular cross section.

9. The method as claimed in claim 1, wherein the bubble rivet has an elongate cross section to provide an extended elongate area of closure.

10. The method as claimed in claim 1, wherein the bubble rivet has graphics applied to it.

11. A packaging product, comprising:

a first member of the packaging product having an aperture therein;

a bubble rivet provided through the aperture, the bubble rivet having an expandable hollow head portion which in use is provided on one side of the aperture and a neck portion which in use is provided in the aperture, wherein the bubble rivet comprises a flexible plastics material enclosing a volume of gas or liquid, wherein the hollow head portion of the bubble rivet is breakable to enable withdrawal of the head portion through the aperture thereby non-reversibly opening the packaging product, and wherein the bubble rivet is released by bursting the flexible plastics material to reduce the volume of the head portion by releasing the gas or liquid contained therein.

12. The product as claimed in claim 11, further comprising:

a second member of the packaging product, wherein a portion of the second member is extruded through the aperture in the first member to form the bubble rivet; and a third member applicable to the second member to seal the extruded bubble rivets such that the gas or liquid is sealed within the bubble rivet.

13. The product as claimed in claim 11, further comprising:

a second member of the packaging product having an aperture corresponding to the aperture in the first member, wherein the bubble rivet is formed of the hollow head portion, the neck portion, and a backing plate, and the hollow head portion or the backing plate of the bubble rivet is pushable through the apertures in both the first member and the second member;

the hollow head portion being expandable on an outside of the first member with the backing plate adjacent the outside of the second member.

14. The product as claimed in claim 11, further comprising:

a second member of the packaging product having an aperture corresponding to the aperture in the first member, wherein the bubble rivet is formed of the hollow head portion, the neck portion, and a second hollow head portion, and one hollow head portion of the bubble rivet is pushed through the apertures in both the first member and the second member;

at least one of the hollow head portions being expandable on one or more of the outside of the first member and the outside of the second member.

15. The product as claimed in claim 14, wherein a first hollow head portion is provided in an inflated state and a second head portion is provided in an uninflated state for insertion through the apertures, wherein the second head portion is inflatable via a one-way valve by squeezing the first hollow head portion.

16. The product as claimed in claim 11, wherein the neck portion is a hollow tube.

17. The product as claimed in claim 11, further comprising providing multiple bubble rivets around the edge of a packaging product.

18. The product as claimed in claim 11, wherein the bubble rivet has a generally circular cross section.

19. The product as claimed in claim 11, wherein the bubble rivet has an elongate cross section to provide an extended elongate area of closure.

20. The product as claimed in claim 11, wherein the bubble rivet has graphics applied to it.

* * * * *